US006201464B1

(12) United States Patent
Inoue

(10) Patent No.: US 6,201,464 B1
(45) Date of Patent: Mar. 13, 2001

(54) THERMISTOR DEVICE HAVING UNINSULATED PERIPHERAL EDGE

(75) Inventor: Hidehiro Inoue, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 08/220,286

(22) Filed: Mar. 30, 1994

(30) Foreign Application Priority Data

Mar. 30, 1993 (JP) ..... 5-015302

(51) Int. Cl.[7] ..... H01C 7/13

(52) U.S. Cl. ..... 338/22 R; 338/225 D; 338/328; 338/324

(58) Field of Search ..... 338/22 R, 225 D, 338/322, 324, 325, 326, 327, 328

(56) References Cited

U.S. PATENT DOCUMENTS 3,296,574 * 1/1967 Tassara ..... 338/327 X
5,210,516 * 5/1993 Shikama et al. ..... 338/22 R

FOREIGN PATENT DOCUMENTS

| | | |
|---|---|---|
| 972851 | 10/1959 | (DE) . |
| 2351956 | 4/1974 | (DE) . |
| 7507461 | 12/1976 | (DE) . |
| 2901711 | 7/1980 | (DE) . |
| 0229286 | 7/1987 | (DE) . |
| 4139157 | 6/1992 | (DE) . |
| 0443618 | 8/1991 | (EP) . |
| 6276504 | 11/1985 | (JP) . |

* cited by examiner

*Primary Examiner*—Karl D. Easthom
(74) *Attorney, Agent, or Firm*—Ostrolenk, Faber, Gerb & Soffen, LLP

(57) ABSTRACT

A thermistor device includes a thermistor element body, an ohmic electrode which is provided on a major surface of the thermistor element body with its outer peripheral edge positioned within that of the thermistor element, thereby defining a gap, and an insulating coating which is formed so as to cover a portion where the outer peripheral edge of the ohmic electrode is in contact with the thermistor element body.

8 Claims, 5 Drawing Sheets

THERMISTOR DEVICE HAVING UNINSULATED PERIPHERAL EDGE

BACKGROUND OF THE INVENTION

1. Field of the Invention

The present invention relates to a thermistor device, which comprises a thermistor element body and an ohmic electrode provided on its major surface.

2. Description of the Background Art

In a positive characteristic (PTC) thermistor and a negative characteristic (NTC) thermistor, a structure is known, comprising a thermistor element body and ohmic electrodes, mainly composed of silver or the like, which are provided on both major surfaces thereof. FIGS. 10 and 11 are respectively a perspective view and a sectional view showing a conventional thermistor device having such a structure. Referring to FIGS. 10 and 11, a PTC thermistor comprises a thermistor element body 1 which is made of a ceramic material such as barium titanate, and ohmic electrodes 2 and 3, mainly composed of silver or the like, which are provided on both major surfaces thereof. In such a thermistor device, the ohmic electrodes 2 and 3 are directly exposed to the outside air. When potential difference is developed across the ohmic electrodes 2 and 3, therefore, electrode components forming the ohmic electrodes 2 and 3 may deposit on an outer peripheral surface 1*c* of the thermistor element body 1 and move to approach each other, to cause shorting across the electrodes 2 and 3. Such a phenomenon is generally called migration, which is very likely to be prompted particularly in a hot and humid atmosphere.

FIGS. 12 and 13 are respectively a perspective view and a sectional view showing the structure of another conventional thermistor device which is known in the art. Referring to FIGS. 12 and 13, this conventional thermistor device comprises a thermistor element body 1 and ohmic electrodes 2 and 3, having smaller areas than the major surfaces of the thermistor element body 1. The ohmic electrodes are provided on the major surfaces. Gap portions 1*a* and 1*b* are defined between outer peripheral edges of the ohmic electrodes 2 and 3 and those of the thermistor element body 1. In the thermistor device having such a structure, it may be possible to prevent shorting caused by the aforementioned migration by defining sufficiently wide gap portions 1*a* and 1*b*. In this case, however, chipping results from a difference in stress between heating and non-heating portions of the thermistor element body 1 caused by thermal expansion, or stress caused by electric field concentration.

In order to prevent such shorting caused by migration, Japanese Utility Model Laying-Open No. 62-76504 (1987) proposes a structure of a thermistor device comprising a thermistor element body and resin coating layers provided on its outer peripheral surface. FIG. 14 is a sectional view showing the thermistor device having such a structure. As shown in FIG. 14, a resin coating layer 4 is provided on an outer peripheral surface of a thermistor element body 1.

However, this structure is not suitable for practical application since the application of such a resin coating layer provided on the outer peripheral surface of a thermistor element body requires a complicated step, to increase the cost.

SUMMARY OF THE INVENTION

An object of the present invention is to provide a structure of a thermistor device which can prevent migration of an electrode material through a simple step while preventing chipping in the vicinity of an outer periphery of a thermistor element body.

The thermistor device according to the present invention is characterized in that an ohmic electrode has an outer peripheral edge that is positioned within that of a thermistor element body to define a gap portion between the outer peripheral edges of the ohmic electrode and the thermistor element, and an insulating coating portion is so formed as to cover a portion where the outer peripheral edge of the ohmic electrode is in contact with the thermistor element body.

According to the present invention, the ohmic electrode which is provided on a major surface of the thermistor element body can be made of a material which is generally employed for an ohmic electrode of a thermistor device, such as a metal or alloy material such as Ag, Ag+Zn/Sb, Ag+In or Al, for example.

According to the present invention, further, the material for the insulating coating portion which is so provided as to cover the contact portion between the outer peripheral edge of the ohmic electrode and the thermistor element body is not particularly restricted, as long as the same has electrical insulativity and is capable of covering the aforementioned portion, so that this material can be prepared from glaze (glass), epoxy resin, silicon resin or the like, for example.

In the thermistor device according to the present invention, the ohmic electrode is so provided that a gap portion is defined between the outer peripheral edges of the ohmic electrode and the thermistor element body. Due to such provision of the gap portion, the electrode material forming the ohmic electrode causes hardly any migration as compared with a structure provided with no gap portion. According to the present invention, further, the insulating coating portion is so formed as to cover the portion where the outer peripheral edge of the ohmic electrode is in contact with the thermistor element body. Therefore, occurrence of migration is further suppressed by the insulating coating portion.

In addition, it is possible to prevent chipping in the vicinity of the outer peripheral portion of the thermistor element body by the insulating coating portion covering the contact portion between the outer peripheral edge of the ohmic electrode and the thermistor element body.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
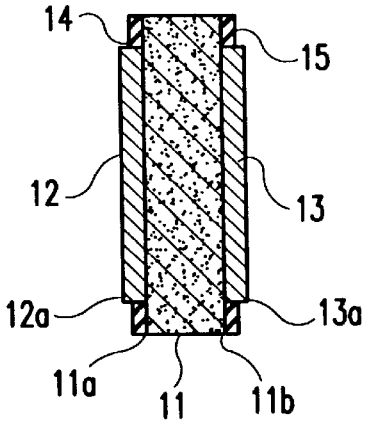
FIG. 1 is a sectional view showing a thermistor device according to a first embodiment of the present invention.
Figure 2:
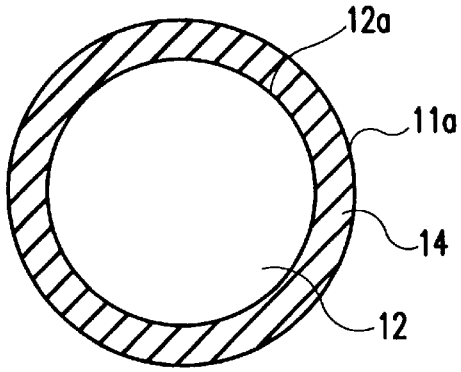
FIG. 2 is a front elevational view showing the thermistor device according to the first embodiment of the present invention.
Figure 3:
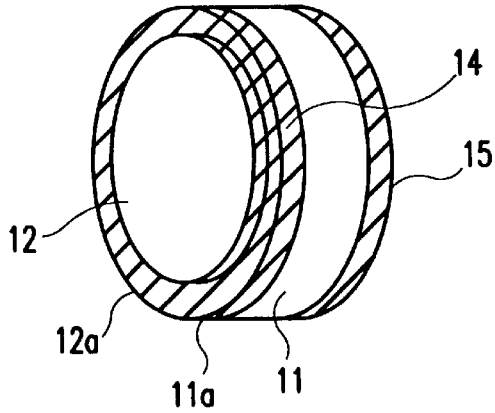
FIG. 3 is a perspective view showing the thermistor device according to the first embodiment of the present invention.

FIGS. 1 to 3 are a sectional view, a front elevational view and a perspective view showing a thermistor device according to a first embodiment of the present invention respectively. Referring to FIGS. 1 to 3, ohmic electrodes 12 and 13 are provided on both major surfaces of a thermistor element body 11 respectively. The ohmic electrodes 12 and 13 are so provided that outer peripheral edges 12*a* and 13*a* are positioned on the inside of outer peripheral edges 11*a* and 11*b* of the thermistor element body 11, whereby gap portions are defined between the outer peripheral edges 12*a* and 13*a* of the ohmic electrodes 12 and 13 and the outer peripheral edges 11*a* and 11*b* of the thermistor element body 11 respectively. According to this embodiment, insulating coating portions 14 and 15 are formed by glaze coating to cover the overall gap portions. The insulating coating portions 14 and 15 can be formed by screen printing similarly to printing of the ohmic electrodes 12 and 13, for example.

Figure 4:
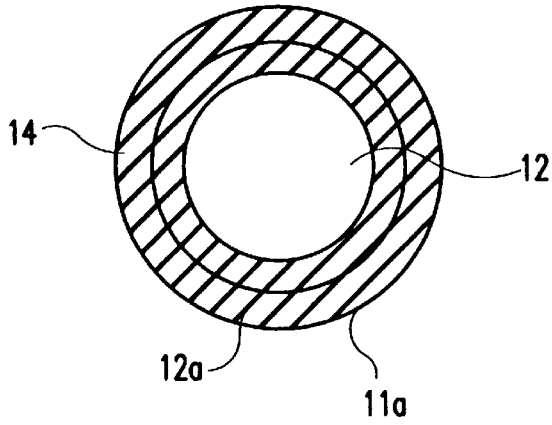
FIG. 4 is a front elevational view showing a thermistor device according to a second embodiment of the present invention.
Figure 5:
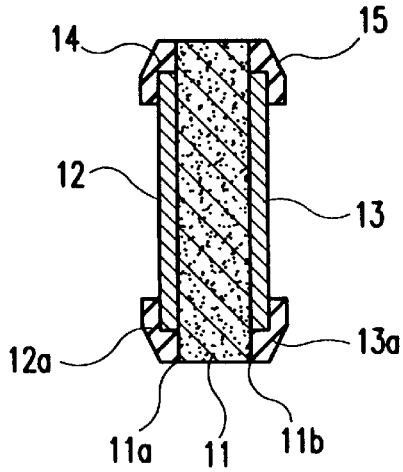
FIG. 5 is a sectional view showing the thermistor device according to the second embodiment of the present invention.

FIGS. 4 and 5 are a front elevational view and a sectional view showing a thermistor device according to a second embodiment of the present invention respectively. Referring to FIGS. 4 and 5, insulating coating portions 14 and 15 are so formed as to cover not only gap portions defined between outer peripheral edges 12*a* and 13*a* of ohmic electrodes 12 and 13 and outer peripheral edges 11*a* and 11*b* of a thermistor element body 11 but outer peripheral portions of the ohmic electrodes 12 and 13 according to this embodiment.

Figure 6:
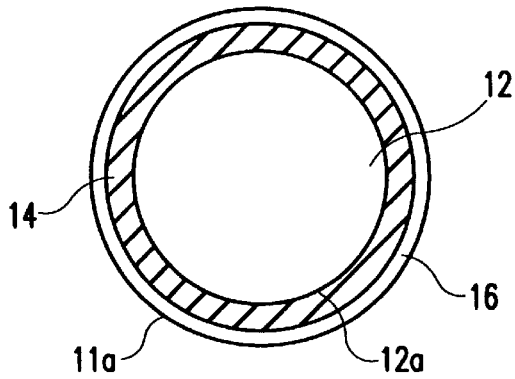
FIG. 6 is a front elevational view showing a thermistor device according to a third embodiment of the present invention.
Figure 7:
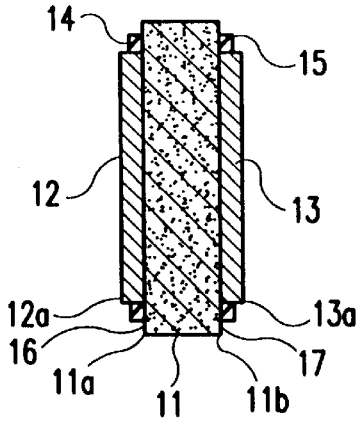
FIG. 7 is a sectional view showing the thermistor device according to the third embodiment of the present invention.

FIGS. 6 and 7 are a front elevational view and a sectional view showing a thermistor device according to a third embodiment of the present invention. Referring to FIGS. 6 and 7, insulating coating outer peripheral gap portions 16 and 17 are formed between outer peripheral edges of insulating coating portions 14 and 15 and outer peripheral edges 11*a* and 11*b* of a thermistor element body 11 according to this embodiment. Thus, the insulating coating portions 14 and 15 may simply cover portions where the outer peripheral edges 12*a* and 13*a* of the ohmic electrodes 12 and 13 are in contact with the thermistor element body 11 in the present invention, and uncovered portions of the thermistor element body 11 may be exposed on outer peripheries of the insulating coating portions 14 and 15.

Figure 8:
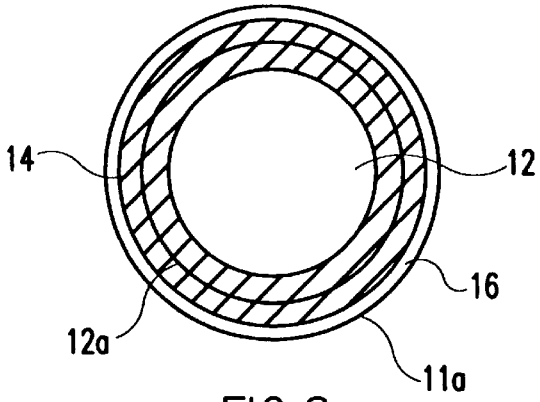
FIG. 8 is a front elevational view showing a thermistor device according to a fourth embodiment of the present invention.
Figure 9:
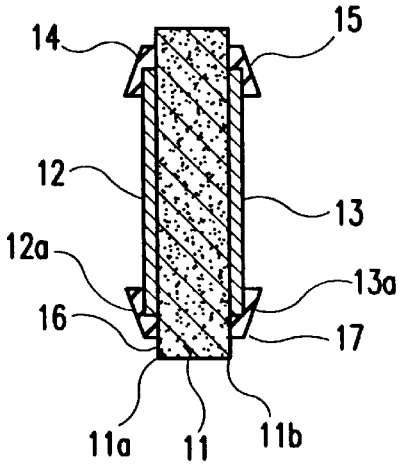
FIG. 9 is a sectional view showing the thermistor device according to the fourth embodiment of the present invention.
Figure 10:
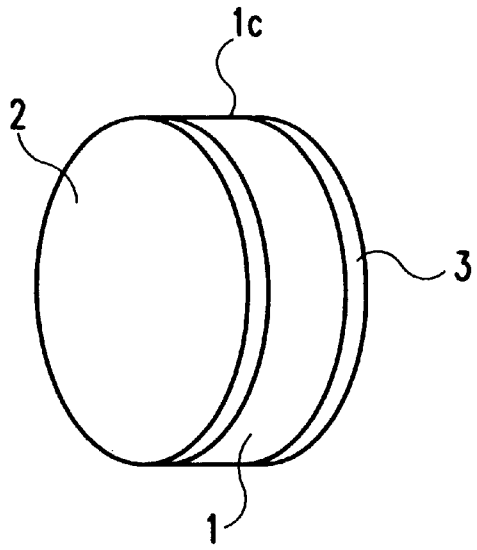
FIG. 10 PRIOR ART
FIG. 10 is a perspective view showing a conventional thermistor device.
Figure 11:
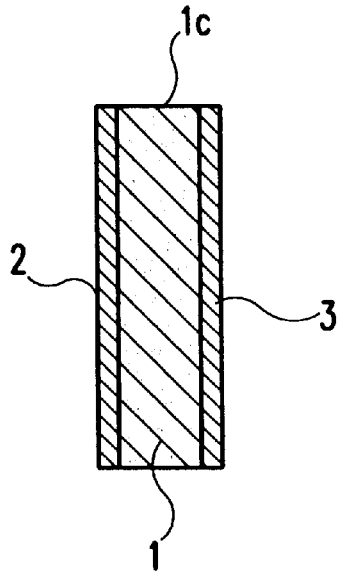
FIG. 11 PRIOR ART
FIG. 11 is a sectional view of the conventional thermistor device shown in FIG. 10.
Figure 12:
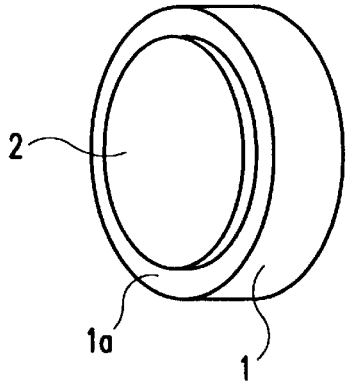
FIG.12 PRIOR ART
FIG. 12 is a perspective view showing another conventional thermistor device.
Figure 13:
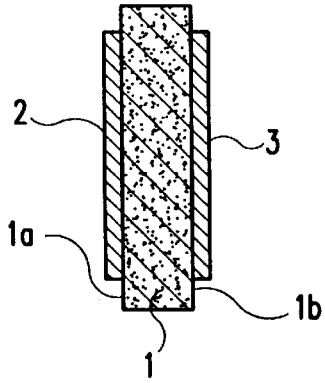
FIG.13 PRIOR ART
FIG. 13 is a sectional view showing the conventional thermistor device show n in FIG. 12.
Figure 14:
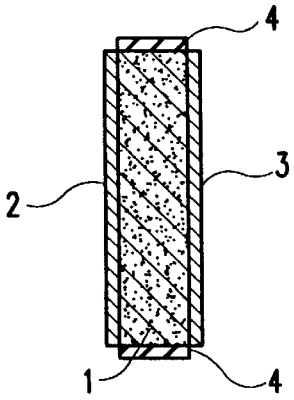
FIG.14 PRIOR ART
FIG. 14 is a sectional view showing still another conventional thermistor device.

FIGS. 8 and 9 are a front elevational view and a sectional view showing a thermistor device according to a fourth embodiment of the present invention. Referring to FIGS. 8 and 9, insulating coating portions 14 and 15 cover parts of gap portions which are defined between outer peripheral edges 12*a* and 13 of ohmic electrodes 12 and 13 and outer peripheral edges 11*a* and 11*b* of a thermistor element body 11, and outer peripheral portions of the ohmic electrodes 12 and 13 according to this embodiment. Thus, uncovered portions of the thermistor element body 11 may be present on outer peripheries of the insulating coating portions 14 and 15, while outer peripheral portions of the ohmic electrodes 12 and 13 may be covered with the insulating coating portions 14 and 15.

According to each of the first to fourth embodiments of the present invention, as hereinabove described, it is possible to prevent migration of electrode components by providing the ohmic electrodes 12 and 13 so that the outer peripheral edges 12*a* and 13*a* thereof are positioned on the inside of the outer peripheral edges 11*a* and 11*b* of the thermistor element body 11 to define the gap portions while providing the insulating coating portions 14 and 15 to cover the portions where the outer peripheral edges 12*a* and 13*a* of the ohmic electrodes 12 and 13 are in contact with the thermistor element body 11.

While the structure according to the present invention is applied onto both major surfaces of the thermistor element body in each of the aforementioned embodiments, the inventive structure is also applicable onto only one major surface of such a thermistor element body.

According to the present invention, the ohmic electrodes are so provided that the outer peripheral edges thereof are positioned on the inside of those of the thermistor element, to define the gap portions. Due to the gap portions, therefore, it is possible to prevent the components of the electrode material forming the ohmic electrodes from migration, thereby preventing the ohmic electrodes from shorting.

According to the present invention, further, the insulating coating portions are so formed as to cover the portions where the outer peripheral edges of the ohmic electrodes are in contact with the thermistor element body, whereby it is possible to cover the outer peripheral edges of the ohmic electrodes forming starting points of migration of the electrode material components, for further effectively preventing migration.

In addition, it is possible to prevent chipping in the vicinity of the outer periphery of the thermistor element body, due to the insulating coating portions.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thermistor device comprising:

a thermistor element body;

an ohmic electrode provided on a major surface of said thermistor element body with its outer peripheral edge positioned within an outer peripheral edge of said thermistor element body, thereby defining a gap portion; and an insulating coating formed at said gap portion at least where said outer peripheral edge of said ohmic electrode is in contact with said thermistor element body, said outer peripheral edge of said thermistor body being free of said insulating coating.

2. A thermistor device in accordance with claim 1, wherein said ohmic electrode is made of at least one material selected from the group consisting of an Ag metal, an Ag alloy, an Al metal and an Al alloy.

3. A thermistor device in accordance with claim 1, wherein said insulating coating is made of at least one material selected from the group consisting of glass, epoxy resin and silicon resin.

4. A thermistor device in accordance with claim 1, wherein said insulating coating covers an outer peripheral portion of said ohmic electrode.

5. A thermistor device in accordance with claim 1, wherein an outer peripheral edge of said insulating coating is positioned within said outer peripheral edge of said thermistor element body.

6. A thermistor device in accordance with claim 5, wherein said insulating coating further covers an outer peripheral portion of said ohmic electrode.

7. A thermistor device in accordance with claim 1, wherein an outer peripheral edge of said insulating coating is positioned at said outer peripheral edge of said thermistor element body.

8. A thermistor device in accordance with claim 7, wherein said insulating coating further covers an outer peripheral portion of said ohmic electrode.

* * * * *